US012637844B2

(12) United States Patent
Erickson

(10) Patent No.: US 12,637,844 B2
(45) Date of Patent: May 26, 2026

(54) MODULAR SIDE-SPRAY FAUCET

(71) Applicant: Kohler Co., Kohler, WI (US)

(72) Inventor: Perry Erickson, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 249 days.

(21) Appl. No.: 18/131,707

(22) Filed: Apr. 6, 2023

(65) Prior Publication Data

US 2023/0323644 A1 Oct. 12, 2023

Related U.S. Application Data

(60) Provisional application No. 63/328,965, filed on Apr. 8, 2022.

(51) Int. Cl.
*E03C 1/04* (2006.01)
*E03C 1/02* (2006.01)

(52) U.S. Cl.
CPC ..... *E03C 1/0404* (2013.01); *E03C 1/0403* (2013.01); *E03C 2001/026* (2013.01); *Y10T 137/9464* (2015.04)

(58) Field of Classification Search
CPC ..... E03C 1/0404; E03C 1/0403; E03C 2001/0416; E03C 2001/0415; E03C 1/023; E03C 2001/026; Y10T 137/9464
USPC ..... 137/801
See application file for complete search history.

(56) References Cited

U.S. PATENT DOCUMENTS 5,372,501 A * 12/1994 Shalvi ..... A61N 1/322 604/20
6,808,131 B2 10/2004 Bosio
7,354,078 B2 4/2008 Yoshino
7,810,848 B2 10/2010 Yoshino
7,909,061 B2 3/2011 Nelson
8,776,828 B2 7/2014 Koo et al.
8,870,095 B2 10/2014 Hughett et al.
8,875,738 B2 11/2014 Yang et al.
9,334,635 B2 5/2016 Keiter et al.
9,616,452 B2 4/2017 Okubo et al.
9,840,831 B1 12/2017 Esche et al.
10,443,757 B1 10/2019 Wang
10,745,895 B2 8/2020 Li
11,053,670 B2 7/2021 Tracy et al.
(Continued)

FOREIGN PATENT DOCUMENTS

CN 113533877 A * 10/2021 ..... G01R 1/025

OTHER PUBLICATIONS

CN113533877A—Machine Translation (Year: 2021).*

*Primary Examiner* — Daphne M Barry
(74) *Attorney, Agent, or Firm* — Husch Blackwell LLP

(57) ABSTRACT

A faucet assembly includes: a linear first waterway defining a first fluid pathway therethrough, wherein the first waterway comprises a valve configured to open and close the first fluid pathway; a curved second waterway defining a second fluid pathway therethrough, wherein a proximal end of the second waterway is configured to fluidically couple to a distal end of the first waterway to define a common fluid pathway through the faucet assembly; a faucet body having an interior surface defining one or more engagement features configured to retain the first waterway in place within the faucet body; and a spray face configured to removably couple to a distal mouth of the faucet body to retain the second waterway within the faucet body.

18 Claims, 7 Drawing Sheets

(56) References Cited

U.S. PATENT DOCUMENTS

| | | | | |
|---|---|---|---|---|
| 2004/0227014 | A1* | 11/2004 | Williams | E03C 1/0404 239/443 |
| 2005/0189438 | A1* | 9/2005 | Bosio | E03C 1/0405 239/443 |
| 2015/0035418 | A1 | 2/2015 | Shiu | |
| 2015/0354186 | A1 | 12/2015 | Tseng | |
| 2017/0101766 | A1 | 4/2017 | Blizzard et al. | |
| 2018/0274214 | A1 | 9/2018 | Rosko et al. | |
| 2019/0382990 | A1 | 12/2019 | Tracy | |
| 2020/0248438 | A1* | 8/2020 | Wang | E03C 1/0405 |
| 2021/0277637 | A1 | 9/2021 | Wu et al. | |

* cited by examiner

MODULAR SIDE-SPRAY FAUCET

PRIORITY CLAIM

The present disclosure claims the benefit of U.S. Provisional Patent Application No. 63/328,965, entitled "FAUCET SIDE SPRAY," and filed on Apr. 8, 2022, the entire contents of which are incorporated herein by reference.

TECHNICAL FIELD

The present disclosure relates generally to sinks and faucets.

BACKGROUND

A sink unit, such as a kitchen sink, a bathroom sink, an industrial sink, or the like, typically includes at least one faucet configured to dispense water from a water supply. In addition to the main faucet, many kitchen sinks include a separate sprayer unit coupled to a flexible hose, wherein the increased range-of-motion is configured to provide the user with greater control over washing tasks. Because the sizes of faucets and spray heads are frequently limited based on size of components and an ability to couple them within the faucet body, it would be advantageous to provide a spray head or faucet assembly having components that are configured to interlock and fit within the faucet body, thereby enabling a reduction in the sizes of faucet parts and thus, the cost of the faucet assembly.

SUMMARY

The present disclosure relates to a faucet having a body configured to house two waterways, wherein the first waterway is configured to interlock with the second waterway. In various examples, the first waterway is a diverter and includes a valve assembly configured to control water flow through the first waterway. In some examples, the second waterway is curved. In some examples, an interior surface of the body defines one or more ridges configured to retain the first waterway, the second waterway, or both. In some examples, a distal end of the first waterway includes a ramped feature defining a circumferential slot configured to engage with a lip disposed on the interior surface of the body, where rotation of the first waterway relative to the second waterway engages the ramped feature and the slot with the lip. In other examples, the ramped feature includes a stop disposed at an end of the circumferential slot, wherein the stop defines a rotational limit of the first waterway relative to the second waterway. In yet other examples, the valve assembly is coupled to a button configured to change an operational state of the valve assembly. In various examples, a second end of the first waterway is configured to be coupled to a hose. In some examples, a second end of the second waterway is configured to couple to a spray face. This summary is illustrative only and should not be regarded as limiting.

BRIEF DESCRIPTION OF THE DRAWINGS

The disclosure will become more fully understood from the following detailed description, taken in conjunction with the accompanying figures, wherein like reference numerals refer to like elements.

DETAILED DESCRIPTION

Before turning to the figures, which illustrate certain examples in detail, it should be understood that the present disclosure is not limited to the details or methodology set forth in the description or illustrated in the figures. It should also be understood that the terminology used herein is for the purpose of description only and should not be regarded as limiting.

Figure 1:
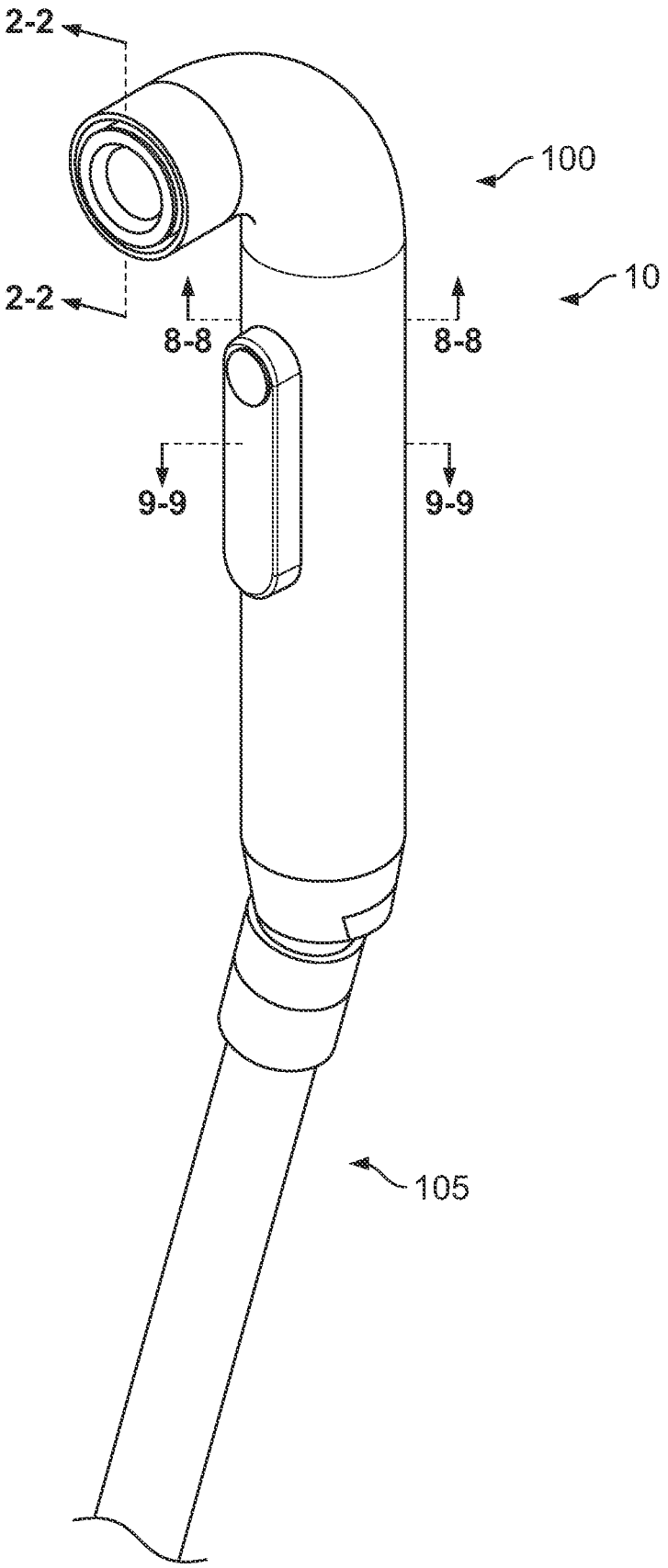
FIG. 1 is a perspective view of a faucet system including a faucet assembly and a hose.

FIG. 1 shows a faucet system 10. Faucet system 10 may include, or may be, a kitchen faucet, a shower spray head, or any other faucet system compatible with a plumbing assembly. Faucet system 10 includes a faucet assembly 100, which is fluidly coupled to a hose 105 configured to provide water to faucet assembly 100, e.g., from a water supply.

Figure 2:
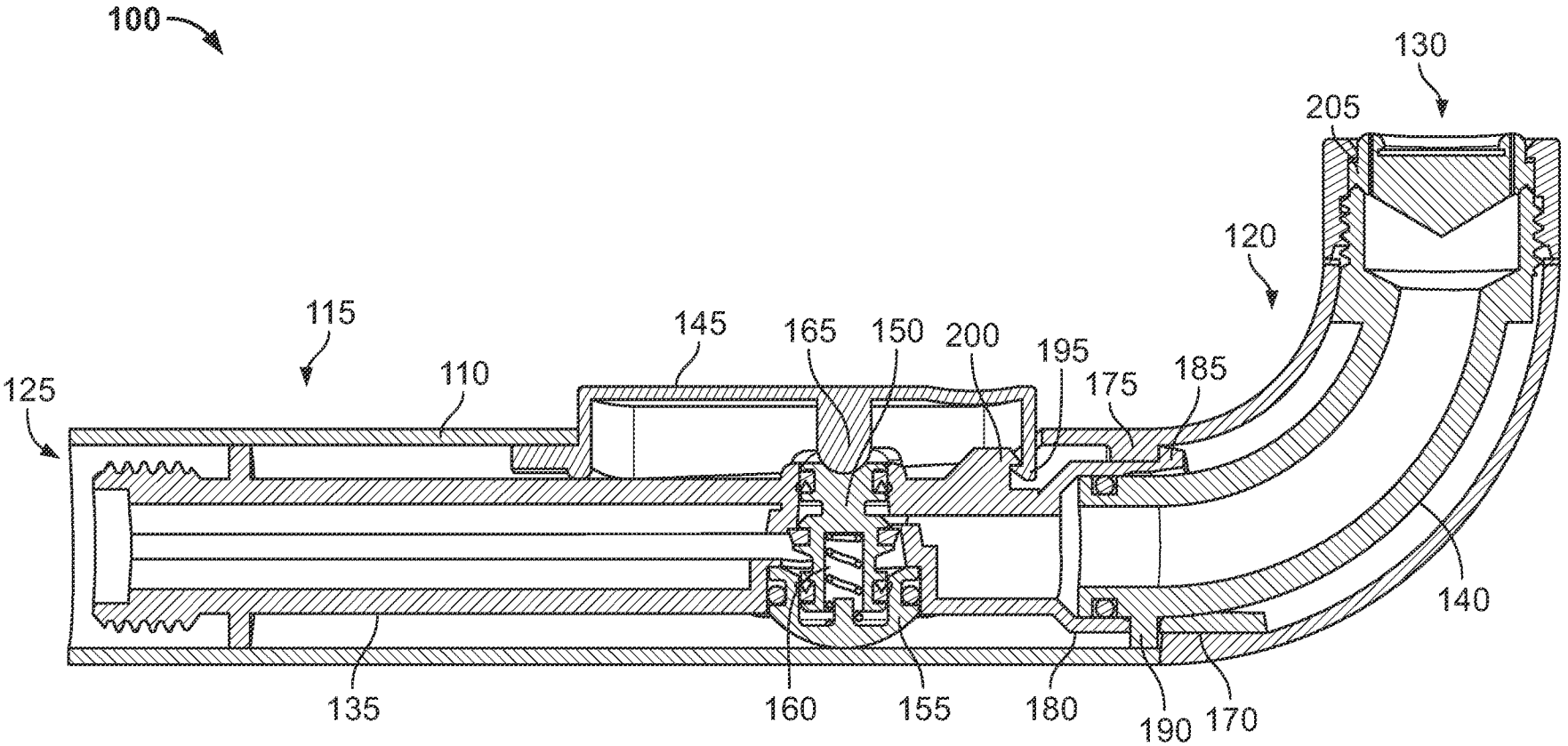
FIG. 2 is a side cross-sectional view of the faucet assembly of FIG. 1, the cross-section taken along line 2-2 of FIG. 1.

FIG. 2 shows a side cross-sectional view of faucet assembly 100 of FIG. 1, as taken along line 2-2 of FIG. 1. Faucet assembly 100 includes a faucet body 110 (or "shell"), which has a substantially linear proximal portion 115 and a curved distal portion 120, which are defined between a proximal end 125 (e.g., adjacent linear proximal portion 115) and a distal end 130 (e.g., adjacent curved distal portion 120). A first tubular waterway 135 disposed within linear proximal portion 115, and a second tubular waterway 140 disposed within curved distal portion 120, collectively enable water to flow through faucet assembly 100. That is, a distal end 180 of first waterway 135 is configured to operably and fluidically couple to a proximal end of second waterway 140, thereby defining a common fluid pathway therethrough.

In various examples, first waterway 135 may be, or may include, a diverter configured to control water flow through the inner lumen thereof. For instance, as shown in FIG. 2, first waterway 135 includes a valve assembly 150 configured to permit, prevent, or adjust a rate of a flow of water through the inner lumen of first waterway 135 (and thus, through faucet assembly 100). In some examples, valve assembly 150 is operable to divert the flow of water through faucet assembly 100 (e.g., through different flow paths, to different sets of water outlets, etc.) to change the spray pattern of the water flowing out of faucet assembly 100. In some examples, valve assembly 150 is operable to enable or disable water flow through a single flow path, and thus functions as an on/off switch for the flow of water. Valve assembly 150 may be operably coupled to, or disposed adjacent to, a button 145 configured to change an operational state of valve assembly 150. As shown, valve assembly 150 is disposed between a base portion 155 and an outermost wall of first waterway 135. A spring 160 biases valve assembly 150 toward the outermost wall of first waterway 135 (i.e., in the upward direction, from the perspective of FIG. 2), e.g., to prevent flow of water therethrough. As shown, button 145 includes a piston or shaft 165 coupled to or integrally formed with an interior portion of button 145, where shaft 165 is configured to engage with or contact a portion of valve body 150. Accordingly, to change an operational state of valve body 150, a user can depress button 145 relative to faucet body 110 to forcibly displace valve body 150 within first waterway 135 and allow water flow therethrough.

As shown in FIG. 2, first waterway 135 may be configured to fluidically couple to second waterway 140, wherein first and second waterways 135, 140 may be further retained within an interior volume of faucet body 110 via one or more placement features disposed within the interior volume of faucet body 110. As shown, faucet body 110 may include a first placement feature 170 (e.g., ridge, lip, etc.) and a second placement feature 175 (e.g., ridge, lip, etc.), wherein first placement feature 170 is configured to engage with a counterpart placement feature 190 (e.g., ridge, lip, etc.) of second waterway 140, wherein second placement feature 175 is configured to engage with a counterpart placement feature 185 (e.g., ridge, lip, slot, ramp, etc.) of first waterway 135, and wherein a distal end 180 of first waterway 135 engages with (e.g., concentrically fits around) a proximal end of second waterway 140.

Button 145 may also be configured to operably couple to first waterway 135 to facilitate depression of valve body 150 as desired. As shown, a distal end of button 145 may include an engagement feature 195 (e.g., hook, ridge, barb, latch, etc.) configured to engage with a counterpart engagement feature 200 (e.g., hook, barb, ridge, lip, latch, etc.) disposed on first waterway 135.

As further shown in FIG. 2, faucet assembly 100 includes a spray face 205, which is configured couple to distal end 130 of faucet body 110, and which is fluidly coupled to first and second waterways 135, 140. In various examples, spray face 205 may be configured to couple faucet body 110 (e.g., the outer shell), second waterway 140 (e.g., disposed within the shell), or both. For instance, faucet body 110, second waterway 140, or both may include a threaded surface configured to engage with a corresponding threaded surface of spray face 205.

Figure 3:
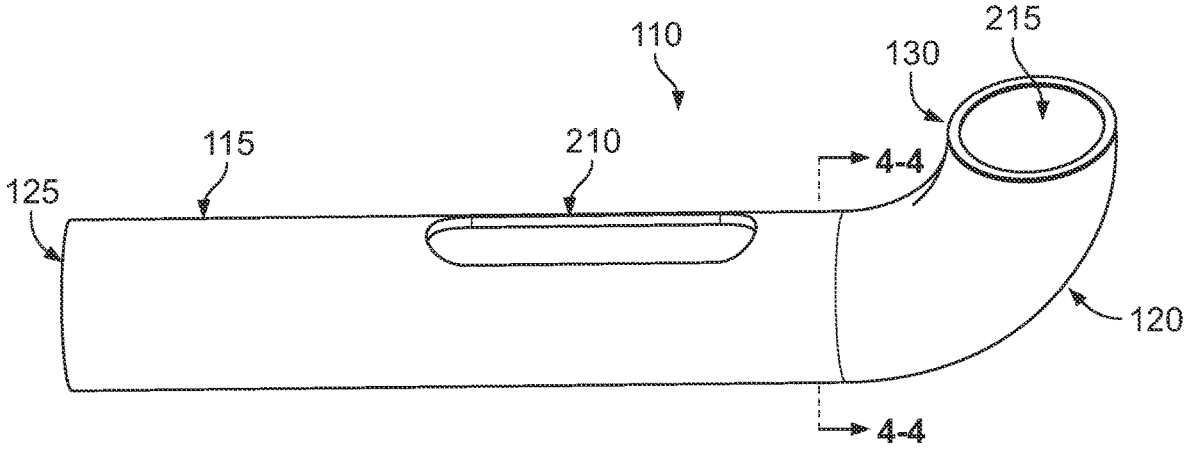
FIG. 3 is a side perspective view of an outer faucet body of the faucet assembly of FIG. 2.

FIG. 3 shows a side perspective view of faucet body 110 of FIG. 2. As previously described, first and second waterways 135, 140 (FIG. 2) are configured to be inserted and retained within an interior volume of faucet body 110. For instance, as shown in FIG. 3, faucet body 110 forms a shell that defines a central, inner bore 215 (or "lumen"), which is configured to receive first and second waterways 135, 140. A sidewall of faucet body 110 also defines at least one aperture 210 configured to receive button 145 (FIG. 2) such that button 145 may be coupled to first waterway 135 and protrude radially outward through opening 210 to facilitate user-access to button 145.

Figure 4:
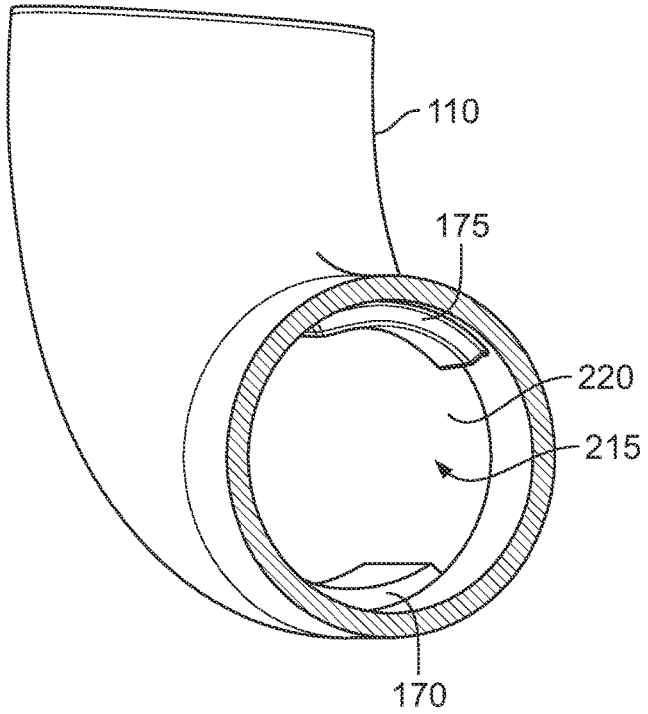
FIG. 4 is a perspective view of a distal portion of the faucet body of FIG. 3, the cross-section taken along line 4-4 of FIG. 3.

FIG. 4 is a cross-sectional view of faucet body 110 of FIGS. 2 and 3, as taken along line 4-4 of FIG. 3. As described above with respect to FIG. 2, faucet body 110 includes first placement feature 170 and second placement feature 175. As shown in FIG. 4, first placement feature 175 and second placement feature 170 may be disposed in an opposing arrangement along an interior surface 220 of inner bore 215 of faucet body 110. As shown, first and second placement features 170, 175 may be disposed between or adjacent a transition region between linear proximal portion 115 and curved distal portion 120 of faucet body 110. In various examples, either or both of first and second placement features 170, 175 may be substantially rectangular-prism shaped.

Figure 5:
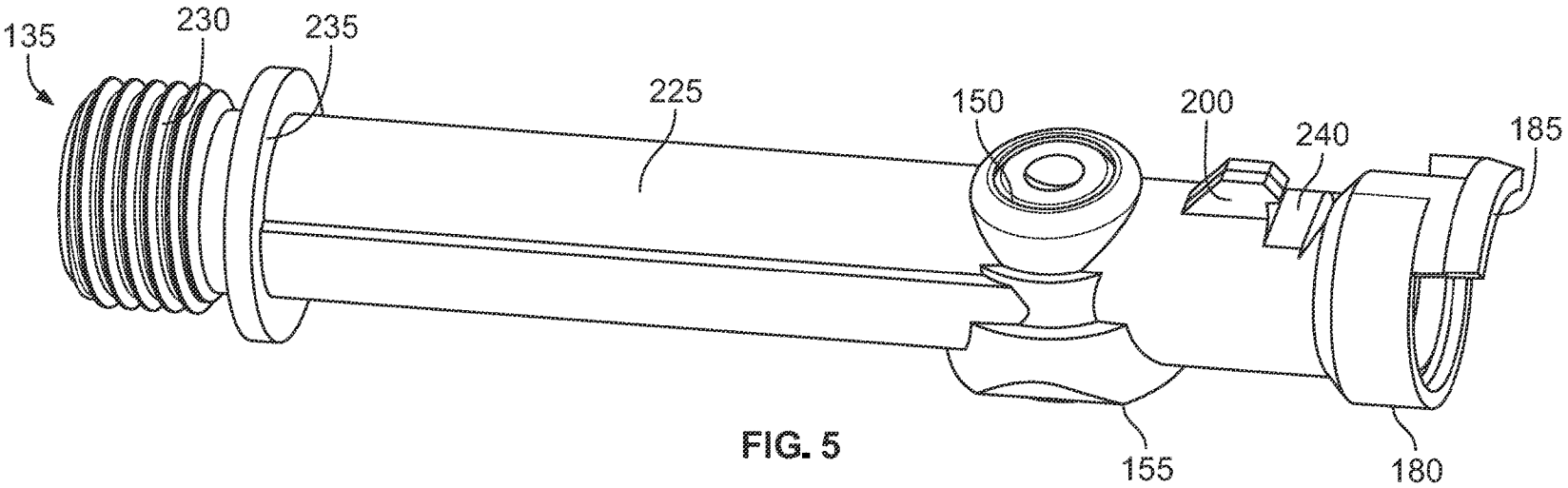
FIG. 5 is a perspective view of a first waterway of the faucet assembly of FIG. 2.

FIG. 5 is a perspective view of an example of first waterway 135 of FIG. 2. As described above, first waterway 135 may be a "diverter." For instance, as shown in FIG. 5, first waterway 135 may include a generally tubular elongated body 225, wherein valve body 150 extends radially inward through elongated body 225 in a direction substantially perpendicular to a primary axis of elongated body 225. In various examples, engagement feature 200 may be disposed near or adjacent to valve body 150. Engagement feature 200 may also be disposed near or adjacent to a slot 240 defined by an outer surface of elongated body 225. In addition, placement feature 185 of first waterway 135 may include a protrusion that extends distally outward from distal end 180 along an axial direction such that, when first and second waterways 135, 140 are disposed within faucet body 110 (FIG. 2), placement feature 185 extends distally toward second waterway 140 to facilitate coupling of first waterway 135 to second waterway 140.

Figure 6:
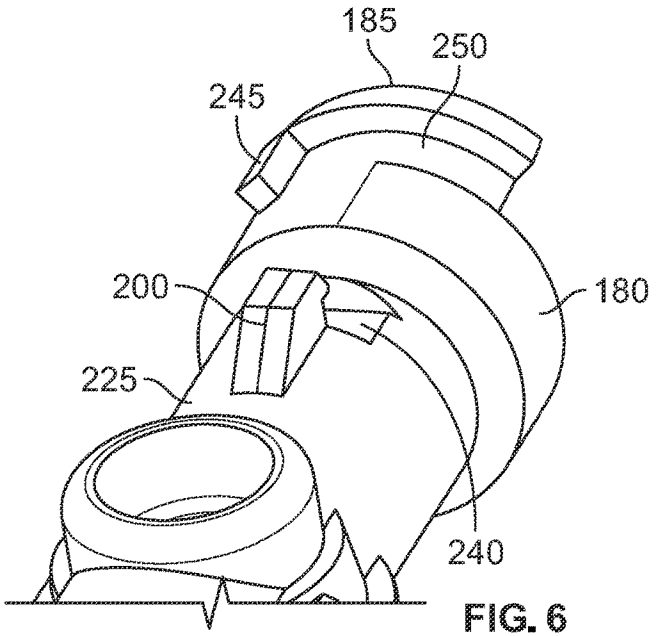
FIG. 6 is a perspective view of a distal portion of the first waterway of FIG. 5.

As shown in FIGS. 5 and 6, engagement feature 200 may include an inclined proximal portion and a straight distal portion such that engagement feature 200 forms a hook, barb, or latch configured to engage with (e.g., "catch," or form an interference fit with) corresponding hooked engagement feature 195 of button 145 (FIG. 2). Slot 240 may be disposed adjacent (e.g., distal to) engagement feature 200 and may be configured to receive a portion of engagement feature 195 of button 145 (FIG. 2).

In various examples, placement feature 185 protruding from distal end 180 may be configured to limit an amount of axial and/or rotational motion of first waterway 135 relative to second waterway 140. For instance, as shown in FIG. 6, placement feature 185 includes a circumferential first ridge 250 and an axial second ridge 245, collectively defining a circumferential slot therebetween. First ridge 250 is disposed along a portion of the circumference of distal end 180 and extends radially outward from elongated body 225. Accordingly, first ridge 250 is configured to engage with second placement feature 175 of faucet body 110 to inhibit or prevent axial motion of first waterway 135 relative to second waterway 140 and/or faucet body 110.

Second ridge 245 may be oriented in a direction substantially perpendicular to first ridge 250. For instance, as shown in FIG. 6, second ridge 245 may be substantially axially aligned with the longitudinal axis of first waterway 135 (e.g., of elongated body 225), and may extend radially outward from elongated body 225. As described above, second placement feature 175 of faucet body 110 (FIG. 2) is configured to be received within the circumferential slot defined by placement feature 185. Accordingly, while first ridge 250 is configured to engage with second placement feature 175 to prevent axial movement of first waterway 135 relative to second waterway 140, second ridge 245 is configured to engage with second placement feature 175 to limit rotational movement of first waterway 135 relative to second waterway 140.

Figure 7:
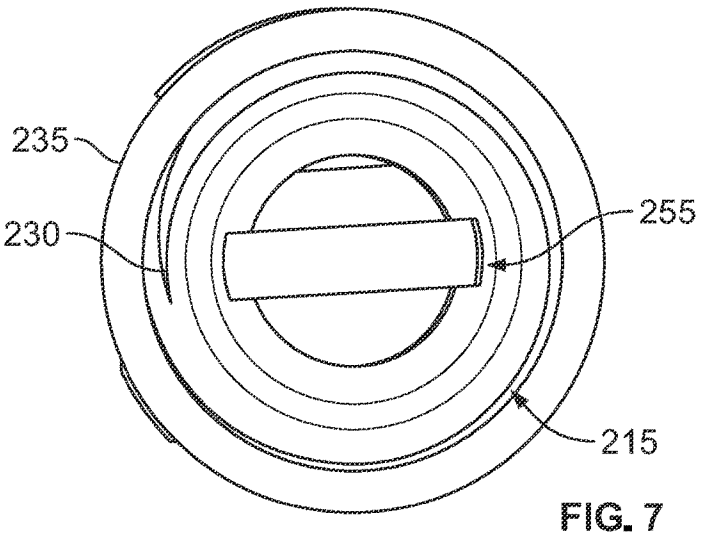
FIG. 7 is an end view of a proximal end of the first waterway of FIG. 5.

In various examples, such as the example shown in FIGS. 5 and 7, a proximal end of first waterway 135 also defines a threaded outer surface 230 and a flange or lip 235. Threaded surface 230 is configured to facilitate coupling of hose 105 (FIG. 1) to faucet assembly 100. In addition, first waterway 135 may include a keyway or key slot 255 disposed within the proximal end of elongated body 225. In various examples, key slot 255 may define a rectangular cross-section, may be substantially axially aligned with elongated body 225, and may be configured to facilitate placement and/or adjustment (e.g., rotation) of first waterway 135 within faucet body 110 (FIG. 2). For instance, key slot 255 may be configured to receive a tool configured to help axially and/or rotationally adjust first waterway 135 relative to faucet body 110.

Figure 8:
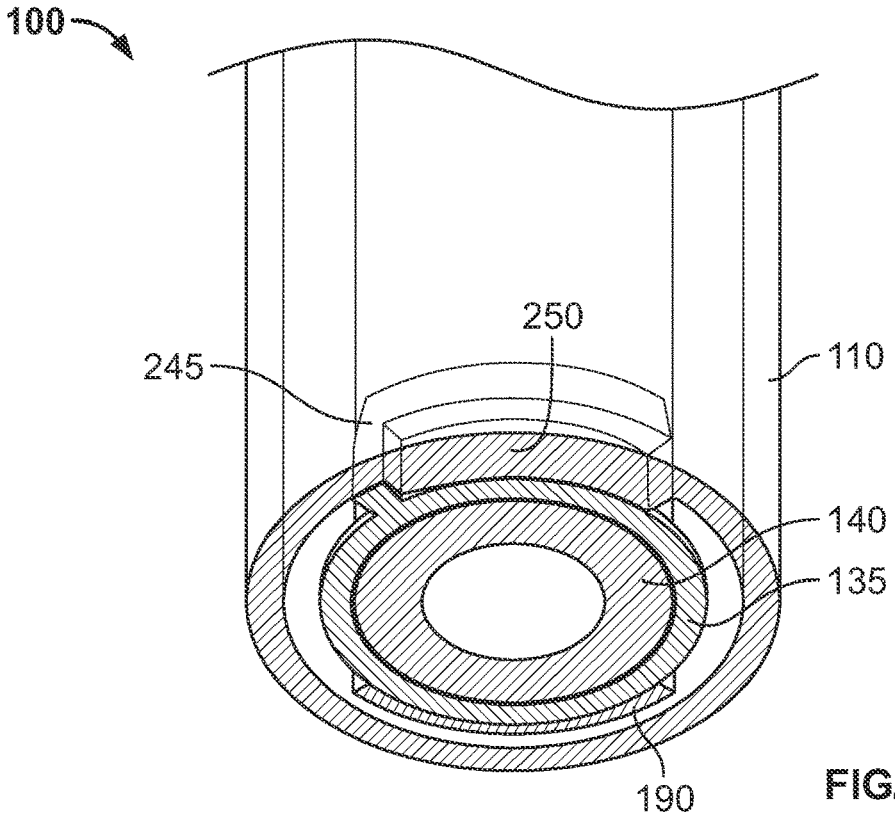
FIG. 8 is a partial cross-sectional view of a distal portion of the faucet assembly of FIG. 2, the cross-section taken along line 8-8 of FIG. 1.

FIG. 8 is a transparent cross-sectional view of a distal portion of faucet assembly 100, the cross-section taken along line 8-8 of FIG. 1, in which first and second waterways 135, 140 are retained within the inner volume of faucet body 110. As shown in FIG. 8, first waterway 135 is operably coupled to second waterway 140 in a concentrically overlapping arrangement. When in the overlapping arrangement shown in FIG. 8, placement feature 185 (FIGS. 5 and 6) engages with second placement feature 175 (FIGS. 2 and 4), and placement feature 190 engages with first placement feature 170 (FIGS. 2 and 4), as described above.

Figure 9:
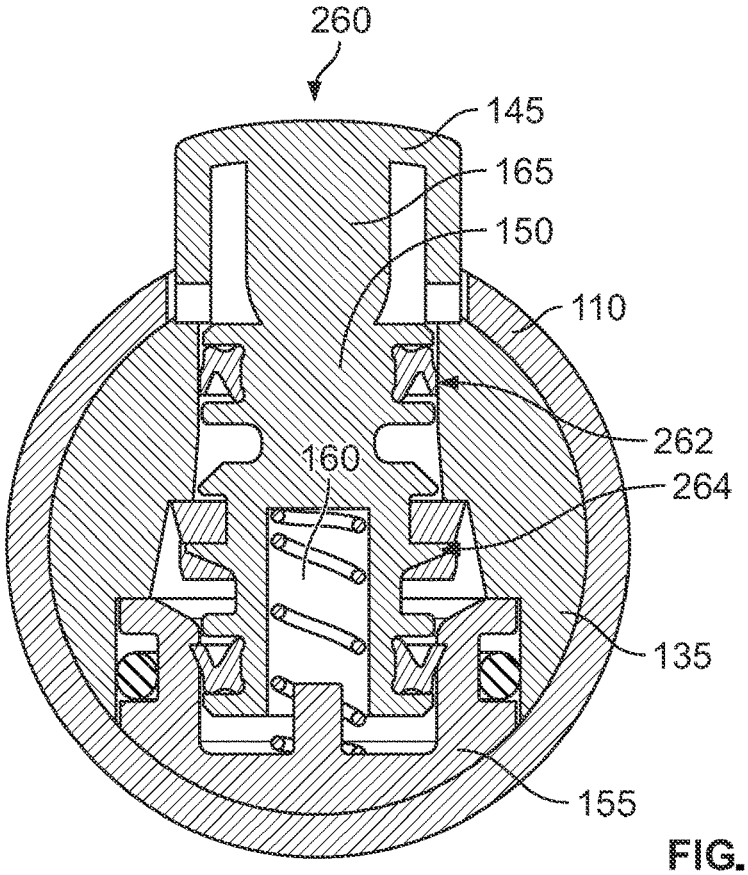
FIG. 9 is a cross-sectional view of a proximal portion of the faucet assembly of FIG. 1, the cross-section taken along line 9-9 of FIG. 1.

FIG. 9 is a cross-sectional view of a proximal portion of faucet assembly 100, the cross-section taken along line 9-9 of FIG. 1, in which faucet assembly 100 is assembled, such that valve assembly 150 is engaged with shaft 165 of button 145. Accordingly, as described previously, a user can depress button 145 by applying a downward (from the perspective of FIG. 9) force onto a top surface 260 of button 145 to displace (e.g., actuate) valve assembly 150. Displacement of valve assembly 150 may constitute a relative sliding motion of valve assembly 150 relative to elongated body 225 of first waterway 135 and base portion 155 in a direction substantially perpendicular to the longitudinal axis of first waterway 135. As shown in FIG. 9, valve assembly 150 may include a valve body 262 configured to obstruct a fluid pathway 264 through first waterway 135 while spring 160 biases valve assembly 150 upward (e.g., in the absence of a user-applied counterforce). Accordingly, when valve assembly 150 is displaced in response to user-actuation of button 145, valve body 262 may shift so as to permit flow of water through fluid pathway 264.

Figure 10:
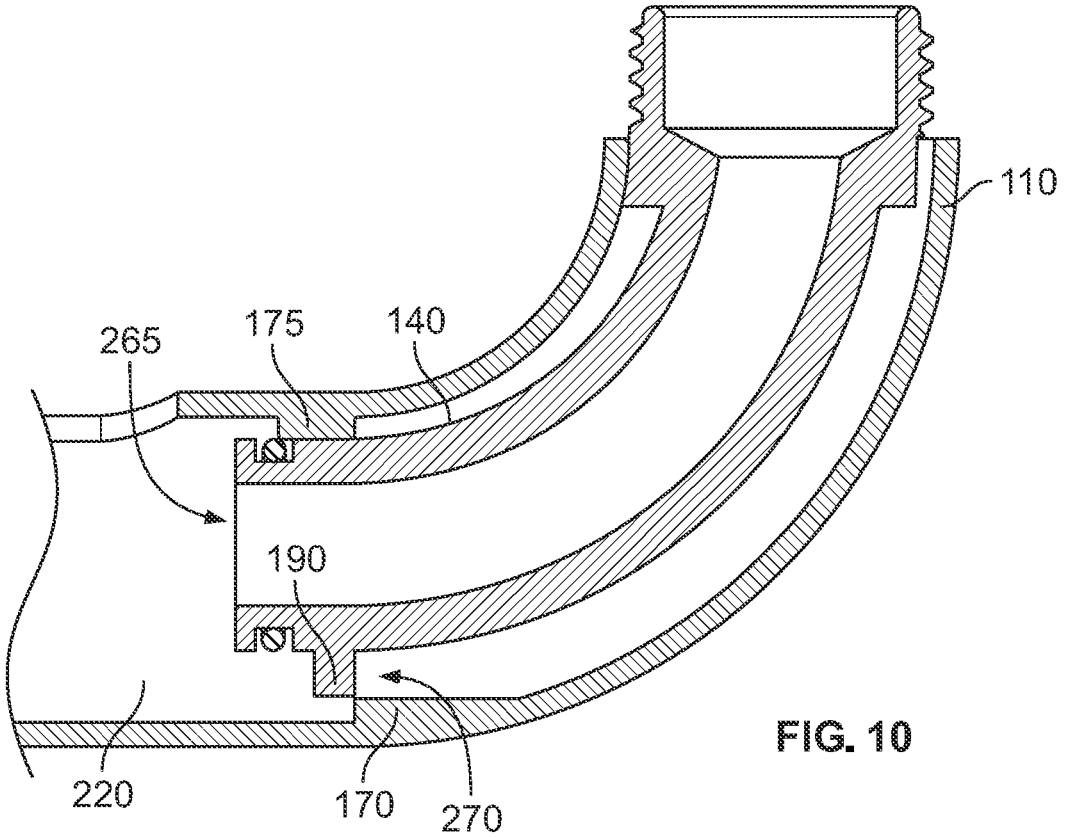
FIG. 10 is a partial cross-sectional side view of the faucet assembly of FIG. 2, the cross-section taken along line 2-2 of FIG. 1, with the first waterway removed, and with the second waterway not yet engaged with the faucet body.
Figure 11:
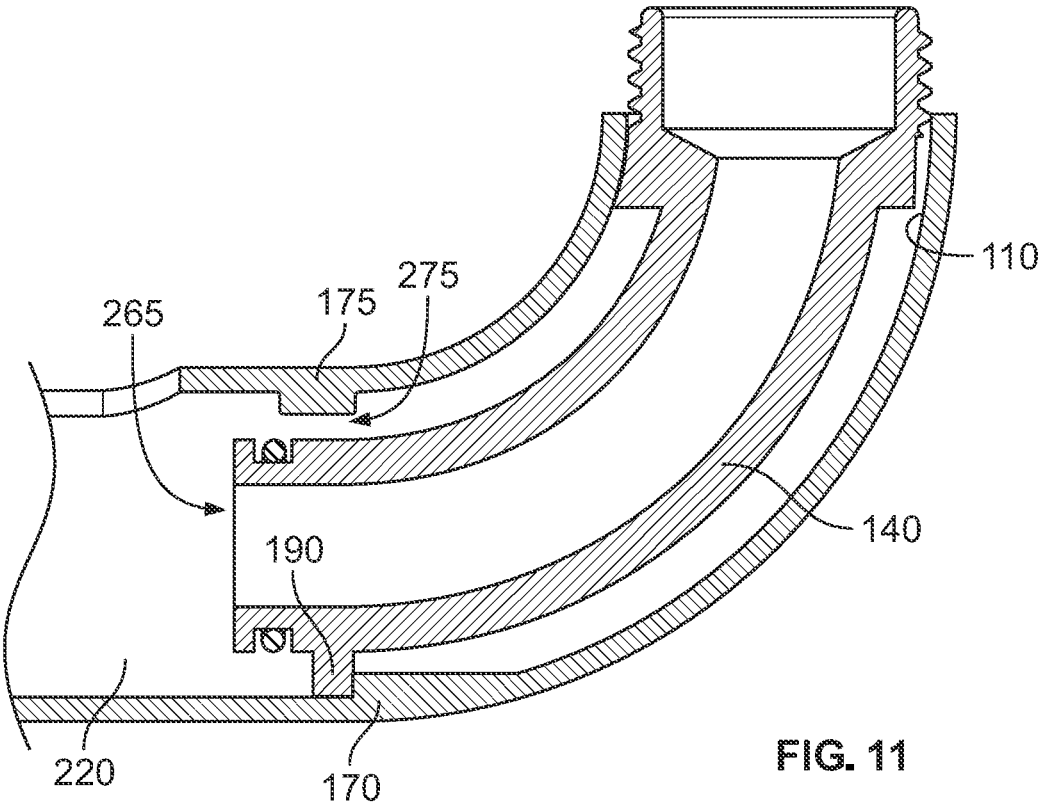
FIG. 11 is a partial cross-sectional side view of the faucet assembly of FIG. 2, the cross-section taken along line 2-2 of FIG. 1, with the first waterway removed, and with the second waterway engaged with the faucet body.

In various examples, second waterway 140 may be secured within faucet body 110 upon insertion and coupling of first waterway 135 within faucet body 110. For instance, as shown in FIG. 10, a proximal end 265 of second waterway 140 may be inserted proximally through distal end 130 (FIGS. 2 and 3) of faucet body 110, such that a radial gap 270 is formed between a lower side of the outer surface of second waterway 140 and inner surface 220 of faucet body 110, which allows placement feature 190 to clear (e.g., not interfere or not engage with) first placement feature 170 during insertion. As shown in FIG. 11, once proximal end 265 of second waterway 140 and placement feature 190 are both disposed proximal to placement feature 170 (i.e., disposed further inward from distal end 130 of faucet body 110 than placement feature 170), second waterway 140 may be shifted downward (from the perspective shown in FIGS. 10 and 11) within faucet body 110 such that radial gap 270 is reduced or eliminated, and a different radial gap 275 is formed between an upper side of the outer surface of second waterway 140 (e.g., opposite the first, lower side of the outer wall of the second waterway 140) and inner surface 220 of faucet body 110. Accordingly, as shown in FIG. 11, upon shifting of second waterway 140, placement feature 190 engages with placement feature 170, and placement feature 175 may be separated from second waterway 140.

Figure 12:
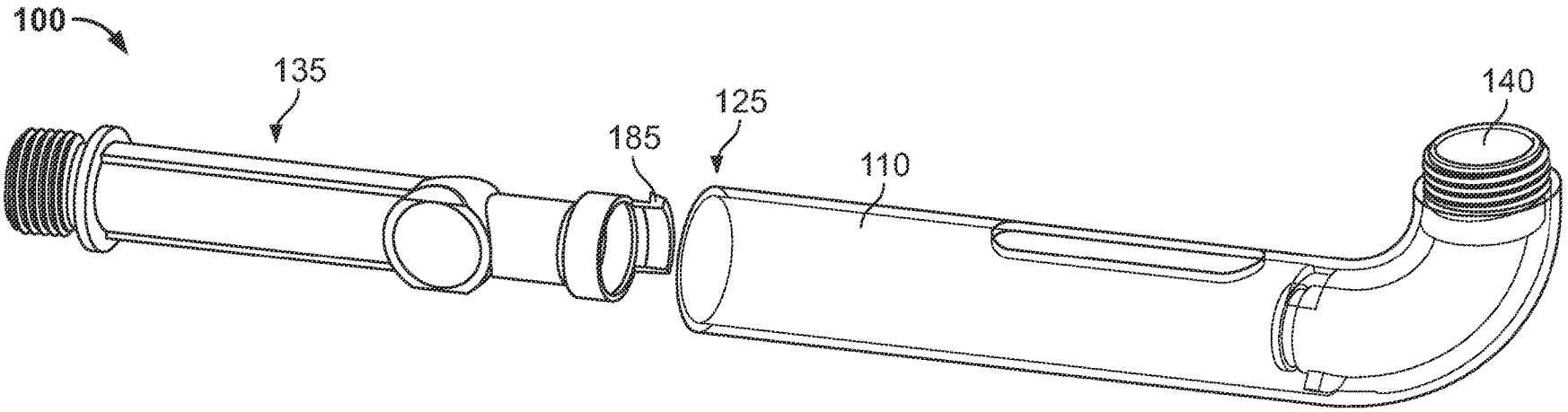
FIG. 12 is a transparent exploded view of the faucet assembly of FIG. 2.

Once second waterway 140 has been shifted within faucet body 110 to form upper radial gap 275, as shown in FIG. 12, the distal end 180 (FIGS. 2 and 5) of first waterway 135 may be inserted distally into proximal end 125 of faucet body 110, such that placement feature 185 of first waterway 135 extends distally toward second waterway 140. Upon insertion, first waterway 135 may be positioned such that placement feature 185 extends into radial gap 275 (FIG. 11) formed between second waterway 140 and faucet body 110, and such that first ridge 250 (FIGS. 6 and 8) engages (i.e., forms an interference fit) with placement feature 175 and distal end 180 of first waterway 135 surrounds proximal end 265 (FIGS. 10 and 11) of second waterway 140. Following placement of first waterway 135 within faucet body 110, and after engagement of first ridge 250 of placement feature 185 with placement feature 175, key slot 255 (FIG. 7) of first waterway 135 may be used to rotate first waterway 135 relative to second waterway 140 until placement feature 175 engages with second ridge 245.

Figure 13:
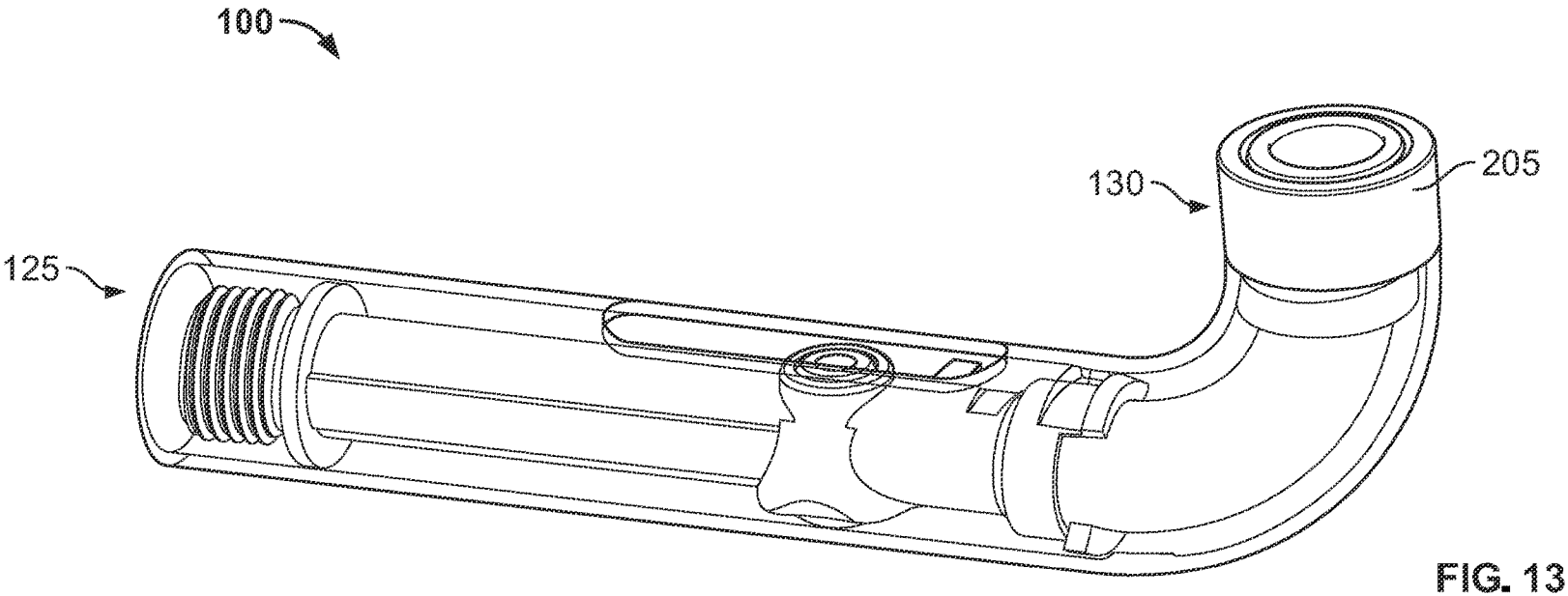
FIG. 13 is a transparent perspective view of the faucet assembly of FIG. 2.

Finally, as shown in FIG. 13, after first and second waterways 135, 140 are inserted within faucet body 110 and are mutually coupled via placement features 185, 190, 170, and 175, spray face 205 may be coupled to the distal end 130 of faucet body 110 and/or second waterway 140, as described above with respect to FIG. 2. Accordingly, because first and second waterways 135, 140 may mutually engage and may be retained by placement features 170, 175 within faucet body 110, faucet assembly 100 may be assembled using relatively few, or even zero, designated fasteners (e.g., screws, pins, clips, etc.), which would otherwise require additional space within faucet assembly 100. In this manner, the arrangements of faucet assembly 100 described herein allow for a substantial reduction in size and/or weight of the assembly 100, and reduces the number of parts (and thus, the associated costs) required for manufacturing and assembly.

As utilized herein with respect to numerical ranges, the terms "approximately," "about," "substantially," and similar terms generally mean +/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various described examples, are intended to indicate that such descriptions are possible examples, representations, or illustrations of possible embodiments (and such terms are not intended to connote that such embodiments are necessarily extraordinary or superlative examples).

The term "coupled" and variations thereof, as used herein, means the joining of two members, directly or indirectly, to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above.

It is important to note that any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A faucet assembly comprising:

a linear first waterway defining a first fluid pathway therethrough, wherein the first waterway comprises a valve configured to open and close the first fluid pathway;

a curved second waterway defining a second fluid pathway therethrough, wherein a proximal end of the second waterway is configured to fluidically couple to a distal end of the first waterway to define a common fluid pathway through the faucet assembly;

a faucet body having an interior surface defining one or more engagement features configured to retain the first waterway in place within the faucet body; and a spray face configured to removably couple to a distal mouth of the faucet body to retain the second waterway within the faucet body, wherein the one or more engagement features comprise a first ridge and a second ridge;

wherein the distal end of the first waterway defines a circumferential slot configured to receive the first ridge; and wherein the proximal end of the second waterway defines a lip configured to engage the second ridge.

2. The faucet assembly of claim 1, wherein rotation of the first waterway relative to the second waterway engages the circumferential slot with the first ridge, and wherein the distal end of the first waterway further defines a stop configured to limit rotation of the first waterway relative to the second waterway.

3. The faucet assembly of claim 1, wherein the first ridge and the second ridge are disposed radially opposite one another along the interior surface of the faucet body, and wherein the first ridge and the second ridge each defines a substantially rectangular-prism shape.

4. The faucet assembly of claim 1, further comprising a button extending radially inward through an aperture defined by the faucet body, wherein actuation of the button is configured to change an operational state of the valve.

5. The faucet assembly of claim 4, wherein actuation of the button comprises a piston configured to compress a spring of the valve to open the first fluid pathway.

6. The faucet assembly of claim 4, wherein the button defines a hook configured to engage with a ramped latch extending radially outward from the first waterway.

7. The faucet assembly of claim 1, wherein a proximal end of the first waterway defines a threaded outer surface configured to couple to a threaded inner surface of a hose.

8. The faucet assembly of claim 1, wherein a proximal portion of the first waterway defines a key slot configured to facilitate adjustment of the first waterway relative to the faucet body.

9. The faucet assembly of claim 8, wherein the key slot defines a substantially rectangular cross-section.

10. The faucet assembly of claim 1, wherein the spray face is configured to threadedly couple to first threads defined by the faucet body and to second threads defined by the second waterway to retain the second waterway in place within the faucet body.

11. A method of assembling a faucet, the method comprising:

proximally advancing a proximal end of a curved waterway into a distal mouth of a faucet body until the proximal end of the curved waterway engages with a first engagement feature of the faucet body;

distally advancing a distal end of a linear waterway through a proximal mouth of the faucet body until the distal end of the linear waterway engages with a second engagement feature of the faucet body, such that the linear waterway and the curved waterway collectively define a common fluid pathway through the faucet body;

rotating the linear waterway about a longitudinal axis to secure the distal end of the linear waterway to the second engagement feature of the faucet body; and screwing a spray head onto the distal mouth of the faucet body to secure the curved waterway within the faucet body.

12. The method of claim 11, wherein proximally advancing the proximal end of the curved waterway until the proximal end of the curved waterway engages with the first engagement feature comprises engaging a lip at the proximal end of the curved waterway with a ridge defined by an interior surface of the faucet body so as to define a radial gap between the curved waterway and the faucet body at a position radially opposite the first ridge.

13. The method of claim 12, wherein distally advancing the distal end of the linear waterway comprises distally advancing the distal end of the linear waterway until a placement feature at the distal end of the linear waterway fits within the radial gap.

14. The method of claim 13, wherein the ridge comprises a first ridge, and wherein rotating the linear waterway about the longitudinal axis comprises rotating the linear waterway to engage a second ridge defined by the interior surface of the faucet body with a circumferential slot defined by the placement feature at the distal end of the linear waterway.

15. The method of claim 11, wherein screwing the spray head onto the distal mouth of the faucet body comprises screwing the spray head onto threads of both the faucet body and of the curved waterway to retain the curved waterway in place within the faucet body.

16. A faucet system comprising:

a water hose; and a faucet assembly fluidically coupled to a distal end of the water hose, wherein the faucet assembly comprises:

a linear first waterway defining a first fluid pathway therethrough, wherein the first waterway comprises a valve configured to open and close the first fluid pathway;

a curved second waterway defining a second fluid pathway therethrough, wherein a proximal end of the second waterway is configured to fluidically couple to a distal end of the first waterway to define a common fluid pathway through the faucet assembly;

a faucet body having an interior surface defining one or more engagement features configured to retain the first waterway in place within the faucet body; and a spray face configured to removably couple to a distal mouth of the faucet body to retain the second waterway within the faucet body, wherein the one or more engagement features comprise a first ridge and a second ridge;

wherein the distal end of the first waterway defines a circumferential slot configured to receive the first ridge; and wherein the proximal end of the second waterway defines a lip configured to engage the second ridge.

17. The faucet system of claim 16, wherein rotation of the first waterway relative to the second waterway engages the circumferential slot with the first ridge, and wherein the distal end of the first waterway further defines a stop configured to limit rotation of the first waterway relative to the second waterway.

18. The faucet system of claim 16, wherein the spray face is configured to threadedly couple to first threads defined by the faucet body and to second threads defined by the second waterway to retain the second waterway in place within the faucet body.

* * * * *